US005860215A

United States Patent [19]

Roskam et al.

[11] Patent Number: 5,860,215

[45] Date of Patent: Jan. 19, 1999

[54] SCISSORS USING A REVERSED HANDLE ORIENTATION WITH A LEVERED HANDLE

[76] Inventors: Scott H. Roskam, 19699 E. Lake Shore; Dennis E. Soucie, P.O. Box 823, both of Bigfork, Mont. 59911

[21] Appl. No.: 693,392

[22] Filed: Aug. 7, 1996

[51] Int. Cl.[6] ..... B26B 13/00

[52] U.S. Cl. ..... 30/254; 30/256

[58] Field of Search ..... 30/254–262, 196, 30/198, 199, 248

[56] References Cited

U.S. PATENT DOCUMENTS

| | | | |
|---|---|---|---|
| 467,130 | 1/1892 | Finnigan . | |
| 624,175 | 5/1899 | Chapman . | |
| 672,050 | 4/1901 | Williamson . | |
| 910,607 | 1/1909 | Sweet et al. . | |
| 923,621 | 6/1909 | Bowes . | |
| 951,236 | 3/1910 | Crider . | |
| 995,090 | 6/1911 | Piper . | |
| 1,005,661 | 10/1911 | Shirt . | |
| 2,294,832 | 9/1942 | Colla, Jr. . | |
| 2,436,560 | 2/1948 | Feather . | |
| 2,469,373 | 5/1949 | Feather . | |
| 2,596,767 | 5/1952 | Erickson . | |
| 2,741,844 | 4/1956 | Sejman et al. . | |
| 2,758,372 | 8/1956 | Gammons . | |
| 3,170,237 | 2/1965 | Weidauer . | |
| 3,289,296 | 12/1966 | Hedstrom et al. . | |
| 3,325,897 | 6/1967 | Luebkeman | 30/254 |
| 3,336,668 | 8/1967 | Groom . | |
| 3,355,200 | 11/1967 | Storch . | |
| 3,533,162 | 10/1970 | Pacitti . | |
| 3,566,467 | 3/1971 | Keiser | 30/257 |
| 3,672,053 | 6/1972 | Wiss . | |
| 4,104,794 | 8/1978 | Carroll . | |
| 4,345,378 | 8/1982 | Pracht . | |
| 4,439,923 | 4/1984 | Scranton . | |
| 4,473,947 | 10/1984 | Ishida et al. . | |
| 4,569,132 | 2/1986 | Hill . | |
| 4,914,820 | 4/1990 | Saito . | |
| 5,125,159 | 6/1992 | Brenton et al. . | |

FOREIGN PATENT DOCUMENTS

| | | |
|---|---|---|
| 807771 | 3/1952 | Germany . |
| 491853 | 9/1938 | United Kingdom . |

OTHER PUBLICATIONS

Matteck Matsuzaki Co., Ltd., Matsuzaki Collection. Dec. 1990, pp. 6 and 7.

Patent Cooperation Treaty International Search Report for International Application No. PCT/US94/06222, Aug. 10, 1994.

*Primary Examiner*—Douglas D. Watts
*Attorney, Agent, or Firm*—Pillsbury Madison & Sutro LLP

[57] ABSTRACT

A scissors that is designed for use by a particular handed person that is modified to be used by an other-handed person (e.g., a left-handed scissors for use by a right handed person) includes a pivot joint, and two blade members pivotally coupled together. At least one blade member has a levered handle behind the pivot joint. The levered handle acts on a fulcrum member to apply a lever force to a portion of the pivot joint to increase the tension and friction between the cutting edges of the blade members, when the motion of the users thumb and fingers would otherwise tend to pull the blade members apart and decrease tension and friction between the blade members, if no levered handle was present.

9 Claims, 12 Drawing Sheets

SCISSORS USING A REVERSED HANDLE ORIENTATION WITH A LEVERED HANDLE

FIELD OF THE INVENTION

This invention relates to scissors that have levered handles to increase tension and friction between the cutting edges of the scissors.

BACKGROUND OF THE INVENTION

Typically, scissors are constructed with two separate, slightly bowed blade members being pivotally coupled together by a pivot joint. The blade members are attached to handles, one handle for the thumb and the other for the fingers of one hand. The blade members contact each other at three main points: along the opposing cutting edge of each blade member, through the pivot joint, and by the contact between the blade members in back of the pivot joint and before the handle of the scissors (the ride area). The pivot joint is placed under an axial load directed along the pivot axis of the pivot joint to keep the blade members together, while the contact in back of the pivot joint acts as a lever with the pivot joint as the fulcrum to produce tension and friction between the cutting edges of the blade members which ensures proper cutting action.

The normal pushing action of a user's thumb against the thumb handle acts on the blade member attached to the thumb handle to lever it, with the pivot joint as the fulcrum, towards the opposing blade to further increase the tension between the cutting edges of the blade members. Typically the user of a haircutting scissors will actuate the cutting motion of the scissors blades by moving the thumb while keeping the fingers relatively still in relation to the rest of his body. The blade member attached to the thumb handle is therefore commonly known as the moving blade while the blade member attached to the finger handle is known as the still blade. Typical prior art haircutting scissors are of necessity made with the still blade facing the users palm and the moving blade facing away from the user when the scissors i held with the fingers above the thumb (the most common position for using haircutting scissors), this orientation is required so that the pressure of the thumb will force the blade members together under increased tension rather than spread them apart. Unfortunately this orientation positions the moving blade in closest contact with the fingers of the other hand as they hold the hair to be cut. The moving blade is also the one in contact with a comb or other implement as it is used to hold the hair being cut. This common blade orientation is found in scissors intended for left handed users and also in scissors for right handed users. Having the still blade facing the palm renders haircutting scissors awkward, because neither scissors blade can be rested easily against a steady guide such as a comb or the fingers of the hand holding the hair to be cut. Thus, there is, in most haircutting operations, the constant risk of cutting either the fingers or the comb that is being used as a guide because the moving blade is the blade in closest proximity to that guide.

SUMMARY OF THE DISCLOSURE

It is an object of an embodiment of the present invention to provide an improved scissors, which obviates for practical purposes the above-mentioned limitations.

An embodiment of the present invention provides an improved scissors having blades orientated such that the still or finger held blade faces away from the palm while maintaining many of the features and functions commonly found in conventional prior art scissors, especially the ability to increase the tension between the blade members by pushing with the thumb against the thumb handle.

In a preferred embodiment of the present invention, a scissors designed for use by a particular handed person is modified to be used by an other-handed person (e.g., a left-handed scissors for use by a right handed person) and includes a pivot joint and two blade members that are pivotally coupled together. At least one blade member has a levered handle substantially behind the pivot joint. The levered handle levers against the pivot joint and presses against a blade fulcrum which is made a part of one blade member to apply a lever force on one side of the blade member to increase the tension and friction between the cutting edges of the blade members, and which counter-acts the natural cutting motion of the user's thumb and fingers that would otherwise tend to pull the blade members apart and decrease tension and friction between the blade members, if no levered handle was present.

Other features and advantages of the invention will become apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF PREFERRED EMBODIMENTS

Figure 1:
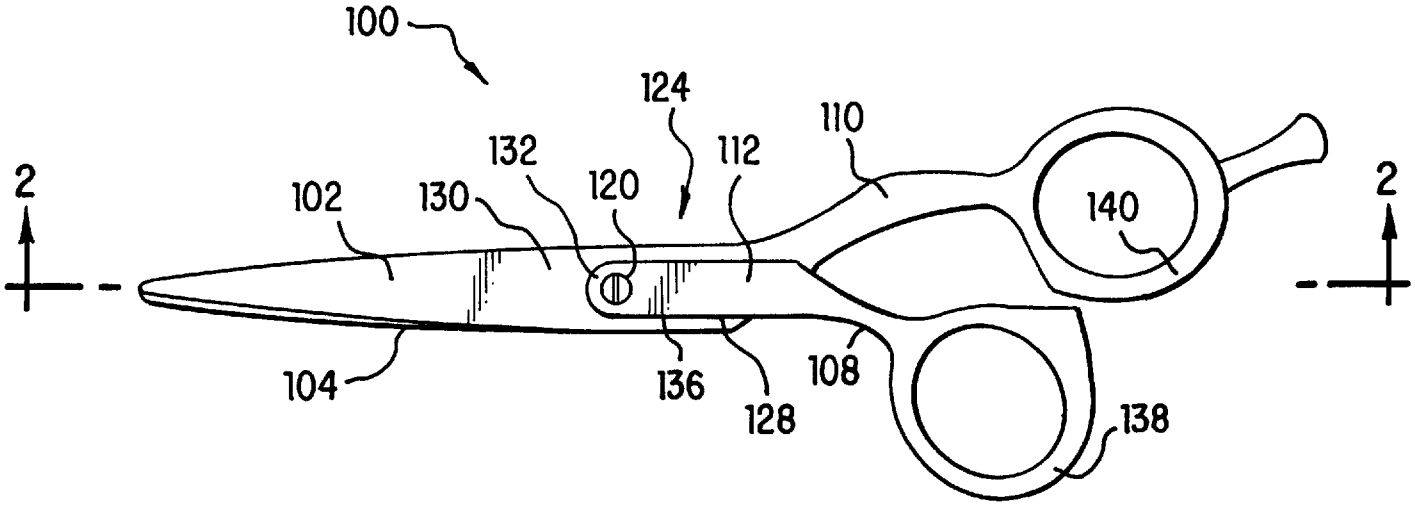
FIG. 1 is a top perspective view of a scissors in accordance with a first embodiment of the present invention.

As shown in the drawings for purposes of illustration, the invention is embodied in an improved scissors that provides improved hair cutting control and minimizes the possibility of injury by placing the moving blade member away from guide objects and fingers. Preferred embodiments of the invention are directed to hair cutting scissors. However, it will be recognized that further embodiments of the present invention include shears, cutters or other instruments which use a scissoring action or a compound shear action with a pivot joint or the like. Moreover, further embodiments of the present invention may be used with scissors having straight blades, curved blades, pinking blades, serrated blades, detachable blades, non-cutting blades, crimping blades or the like.

Figure 2:
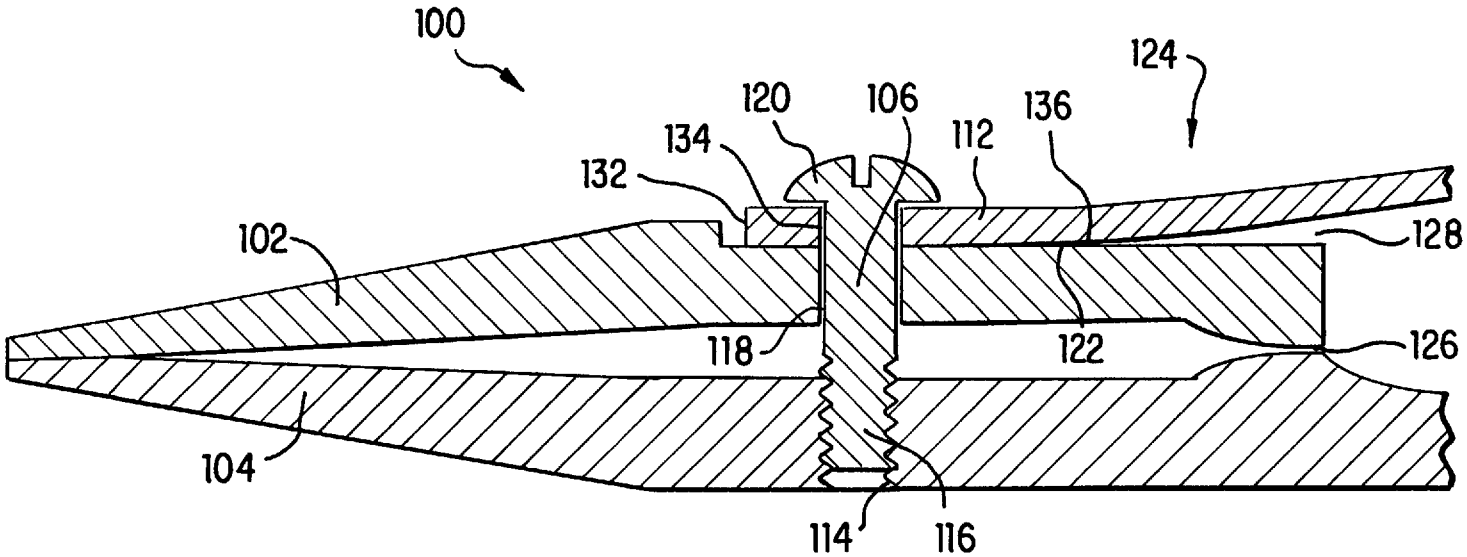
FIG. 2 is a partial cross-sectional view of the scissors shown in FIG. 1 as viewed along the line 2—2.

In preferred embodiments of the present invention, a scissors 100 has a moving cutting portion or blade member 102 (or thumb member), a still cutting portion or blade member 104 (or finger member) and a pivot pin 106. Each of the cutting portions 102 and 104 has a cutting edge that mates with the cutting edge on the other cutting portion to cut during movement of the scissors. Connected to the moving blade member 102 is a thumb handle 108 and connected to the still blade member 104 is a finger handle 110. In preferred embodiments, the finger handle 110 is formed integrally with the still blade member 104 and the thumb handle 108 is connected to the moving blade member 102 and the pivot pin 106 by a lever 112 formed at one end of the thumb handle 108. In alternative embodiments, the finger handle 110 may be formed as a separate piece that is then secured to the still blade member 104. As shown in FIGS. 1 and 2, the orientation of the thumb handle 108 and a finger handle 110 are interchanged from the typical handle arrangement found on typical prior art right-handed scissors so that the scissors 100 would be designed for use by a particular handed person (e.g., a left-handed person).

As shown in FIGS. 1 and 2, the still blade member 104 (or finger member) of the scissors 100 contains a threaded pivot pin hole 114 formed in the still blade member 104 which secures a threaded end 116 formed on one end of the pivot pin 106. The moving blade member 102 includes a pivot joint hole 118 and the pivot pin 106 passes through the pivot joint hole 118 formed in the moving blade member 102. The pivot pin 106 has a flanged head 120 formed on the other end of the pivot pin 106, which holds the moving blade member 102 in contact with the pivot pin 106 and the still blade member 104. The moving blade member 102 is pivotally coupled to the still blade member 104 by the pivot pin 106 creating a pivot axis within the pivot joint. In this embodiment, the pivot pin 106 and the connection points with the moving blade member 102 and the still blade member 104 form and define the pivot joint of the scissors. However, it should be understood that in alternative embodiments, the pivot joint may be defined to include additional areas of the scissors around the pivot pin and may include other members or elements that operate on the pivot pin and the areas surrounding the pivot pin of the scissors.

The moving blade member 102 (or thumb member) includes a longitudinal axis generally parallel to the line 2—2 shown in FIG. 1, and a lever joint fulcrum point 122 located within a lever joint section 124 formed on an end of the moving blade member 102 that is closest to a ride area 126 between the moving blade member 102 and the still blade member 104. A lever slot 128 is cut into a top surface 130 of the moving blade member 102 in the lever joint section 124 for receiving and laterally securing the lever 112 within the lever slot 128. The lever 112 is secured in a manner that generally inhibits movement in a plane perpendicular to the pivot axis while permitting vertical movement in a plane generally parallel to the longitudinal axis of the moving blade member 102 and generally parallel to the pivot axis of the pivot joint. The lever slot 128 extends through the lever joint section 124 to and beyond the pivot pin hole 118 in the moving blade member. In alternative embodiments, the lever slot may be formed in a rectangular or other angular shape or a plurality of lever slots may be formed to accept a plurality of levers.

At one end of the lever 112 is a lever force transmitting end 132 into which is bored a lever hole 134 through which passes the pivot pin 106. The pivot pin 106 secures the lever 112 to the moving blade member 102. The flanged pivot pin head 120 contacts the lever force transmitting end 132 and both serves to maintain the lever 112 in a secured position and serves to receive the levering force exerted by the lever 112. Contacting the lever joint fulcrum point 122 of the moving blade member 102 is a lever contact point 136 which is part of the lever 112 which is fitted into the lever slot 128. The other end of the lever 112 is connected to the thumb handle 108 which acts upon the lever 112 when it is pushed by the thumb of the user to lever up against the flanged pivot pin head 120 of the pivot pin 106. In preferred embodiments the lever slot 128 is cut flat and the lever 112 is curved, bent, bowed or the like as shown in FIG. 2. In operation, as the users thumb pushes the thumb handle 108 away from the users palm during the cutting operation, the lever 112 is pushed down on the side of the lever fulcrum point 122 causing the lever force transmitting 132 end to rock up and apply upward pressure on the flanged pivot pin head between the flanged pivot pin head and the moving blade lever 102. In alternative embodiments the lever slot 128 may be cut with a curve or bow that is convex or with a plurality of angled flat cuts to cooperate with a straight or a curved lever 112. In further alternative embodiments a combination of angled cuts and bends or the like may be used on either the lever 112 or the lever slot 128. In preferred embodiments, the lever 112 of the scissors 100 is ridged and does not flex being formed from solid metal which is securely maintained in the unlevered position (see FIG. 1) by the flanged pivot pin head 120. However, in alternative embodiments, the is lever 112 may have flexing capabilities and may be formed from other materials or a rubber gasket, elastomeric o-ring, belleville washer or the like may be placed between the flanged pivot pin head 120 and the lever force transmitting end 132.

The movement of the thumb handle 108 causes a corresponding lever force to press the lever contact point 136 of the lever against the lever joint fulcrum point 122 to press the moving blade member 102 against the still blade member 104 thereby further increasing the tension and pressure between the cutting edges of the blade members. Thus, the increased lever force on the pivot joint substantially offsets or counter-acts the effect of the pull away motion (or tension and friction reducing effects) of the thumb in a thumb hole 138 of the thumb handle 108. Thus, proper cutting tension and friction are maintained.

The scissors 100 has a finger hole 140 in the finger handle 110. The finger handle 110 is coupled to the still blade member 104 (the thumb activated moving blade 102 tends to move relative to the finger held still blade member 104). In operation, the scissors 100 is grasped by the user, with the thumb placed through a thumb hole 138 of the thumb handle 108, and a finger placed through the finger hole 140 of the of the finger handle 110.

To use the scissors 100, the user moves the thumb back and forth to produce a scissoring action between the cutting edges of the blade members. However, since the scissors 100 are primarily designed as left-handed scissors for use by a right-handed person, the thumb tends to engage the moving blade member 102 (or thumb activated moving blade) in a manner that tends to pull the cutting edges of the blade members 102 and 104 away from each other. This tends to decrease friction, and increase undesired wear and instability in the scissors. However, the lever force applied by the lever 112 on the thumb handle 108 to the moving blade member 102 counteracts this tendency to pull apart the moving blade member 102 and the still blade member 104 and actually forces the blades into closer contact to increase tension and friction between the moving blade member 102 and the still blade member 104.

Tension between the contacting cutting edges of the blade members 102 and 104 is maintained by the lever force exerted in the ride area 126 between the blade members 102 and 104 with the flanged pivot pin head 124 serving as a fulcrum for the levering action. The scissors 100 illustrated in FIGS. 1 and 2 would be suitable for use by left-handed persons, if no levered handle was present. Using a left-handed scissors in a right hand has the benefit of placing the moving blade member 102 away from another implement or the fingers of the hand holding the hair to be cut during the cutting operation. (i.e., the moving blade member 102 faces the palm of the user's hand and the still blade member 104 faces away from the user). However, without a lever force on the moving blade member 102, the cutting action of a left-handed scissors would spread the moving blade member 102 and the still blade member 104 apart and reduce tension and cutting efficiency.

In alternative embodiments, the use of a right-handed scissors that is formed like the scissors 100 for use by a left-handed person can be effected in a similar manner and would have the same attributes as the scissors 100 described above.

Should one use the scissors 100, as herein disclosed, in the left hand, the thumb pushing the thumb handle away from the palm will cause the lever 112 to rock on the lever force transmitting end engaging the lever slot 128 to lever up on the pivot joint forcing the blades into closer contact to increase tension and friction between the moving blade member 102 and the still blade member 104.

Embodiments of the scissors in accordance with the present invention can be used effectively in all cutting situations for more control, since the lever action forces the moving blade member 102 and the still blade member 104 together to increase tension and cutting efficiency during the cutting action. For example, when cutting hair, the illustrated blade orientation would allow the user to support the still blade member 104 on the fingers holding the hair to be cut to increase stability and reduce the possibility of injury. Thus, the scissors 100 can be used for more controlled cutting with less risk of injury.

Figure 3:
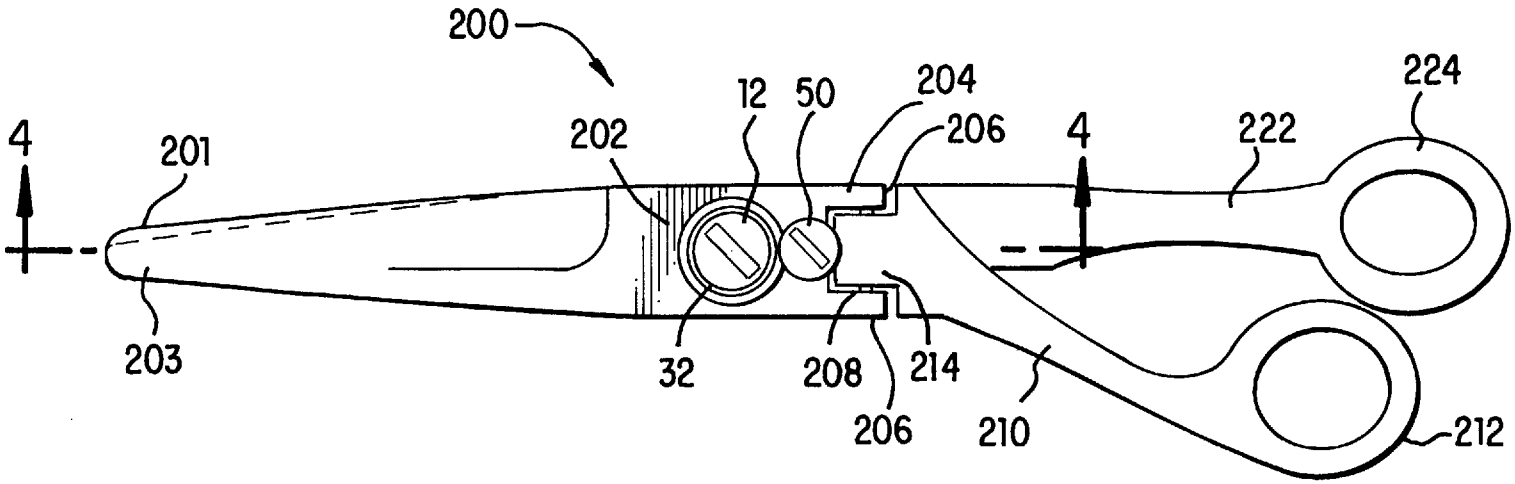
FIG. 3 is a partial top perspective view of a scissors in accordance with a second embodiment of the present invention.
Figure 4:
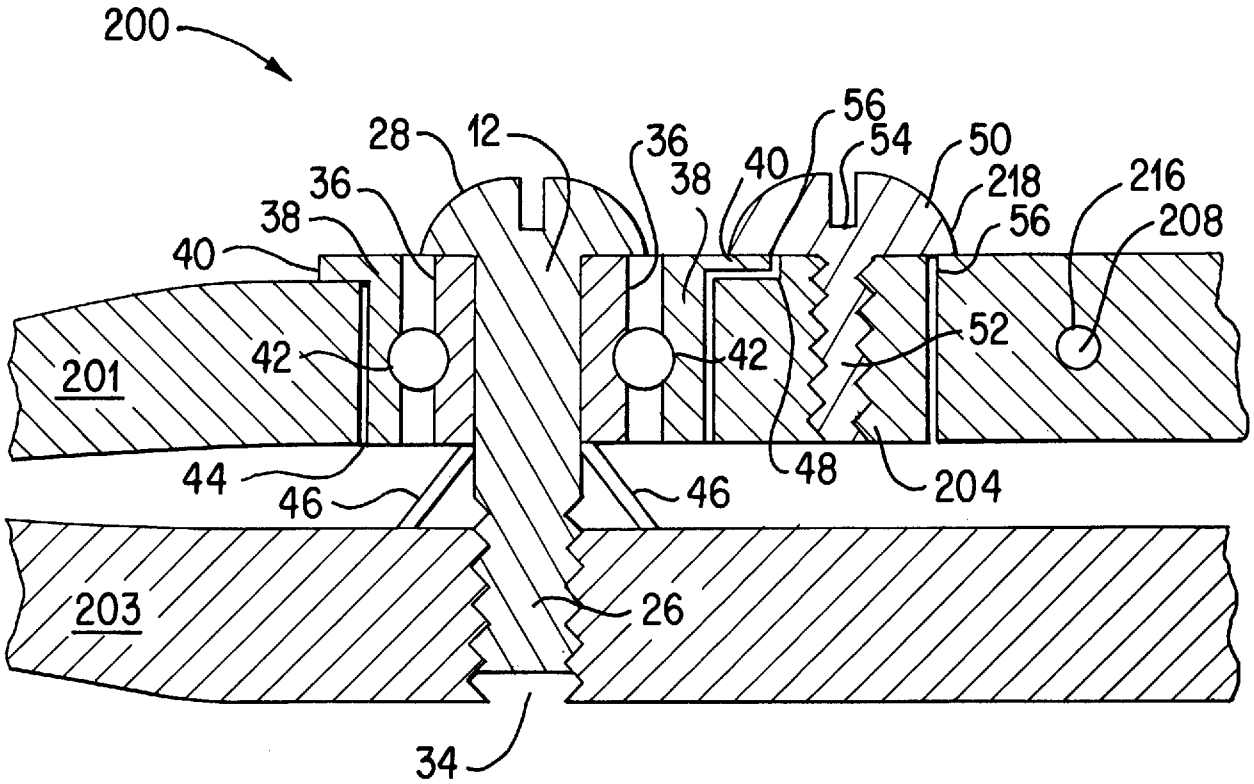
FIG. 4 is a partial cross-sectional view of the scissors shown in FIG. 3 as viewed along the line 4—4.
Figure 5:
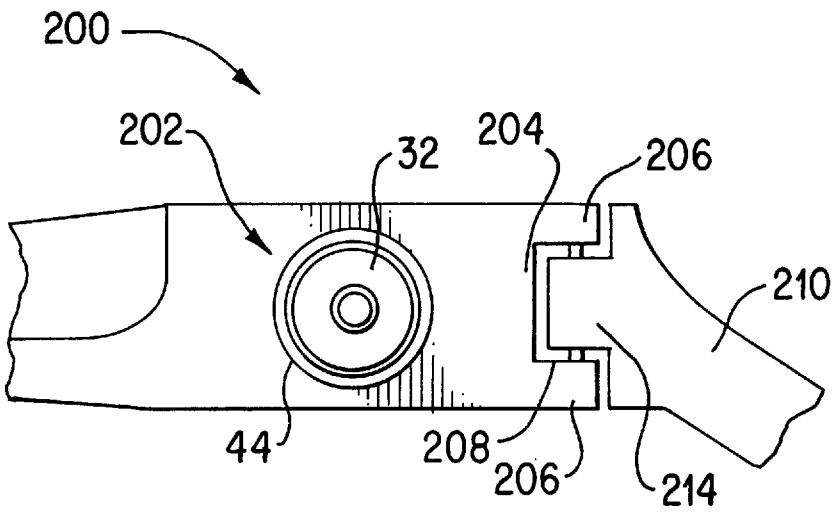
FIG. 5 is a partial bottom perspective view of the scissors handle shown in FIG. 3.
Figure 6:
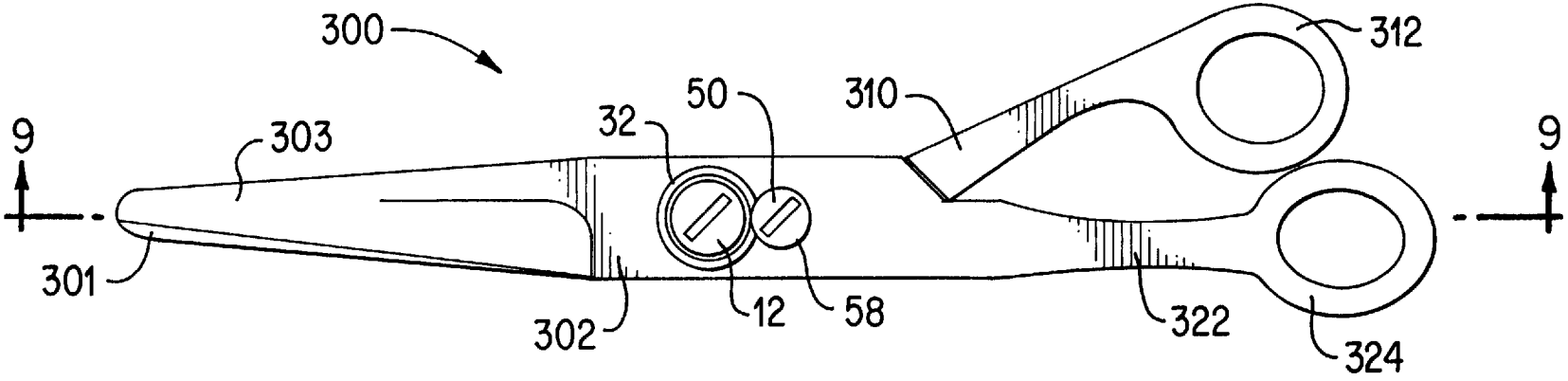
FIG. 6 is a top perspective view of a scissors in accordance with a third embodiment of the present invention.
Figure 7:
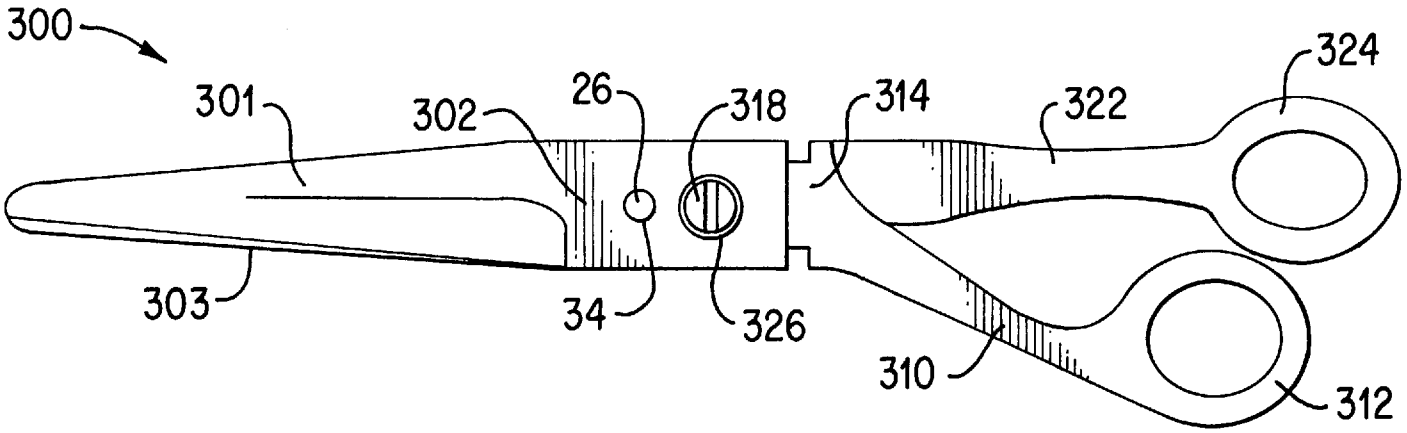
FIG. 7 is a bottom perspective view of the scissors shown in FIG. 6.

A second improved scissors 200 in accordance with an alternative embodiment of the present invention is shown in FIGS. 3–5. The scissors 200 also has a thumb handle and a finger handle interchanged so that the scissors 200 would be designed for use by a particular handed person (e.g., a left-handed person), if no other modifications are made. However, at least one of the handles of the scissors 200 in FIGS. 3–5 is then further modified for use by an other-handed person (e.g., a left-handed scissors for use by a right handed person). The scissors uses an improved pivot joint and rideless construction as described in U.S. Pat. No. 5,440,813 issued Aug. 15, 1995, which is herein incorporated by reference.

As shown in FIGS. 3 and 4, the scissors 200 includes a still blade member 203 (or finger member) and a moving blade member 201 (or thumb member). The moving blade member 201 of the scissors 200, contains a ball bearing assembly 32 and a connecting pin 12 in a pivot joint hole in the form of a bearing assembly hole 44. The moving blade member 201 also includes a tension screw 50 that is threaded into a tension hole 58 to contact and engage a flange 40 of the ball bearing assembly 32 to adjust the tension and friction between the blade members 201 and 203. The still blade member 203 (or finger member) holds a threaded end 26 of the connecting pin 12 in a threaded connecting pin hole 34. Since the thumb handle and moving blade member holds the ball bearing assembly 32, the pivot joint would be orientated to face in a different direction relative to the palm of the users hand. Thus, the scissors 200 illustrated in FIGS. 3 and 4 would be suitable for use by left-handed persons, if no hinged handle was present. Using a left-handed scissors in a right-hand has the benefit of placing the moving thumb blade member away from an area or other fingers during the cutting operation. Embodiments of the scissors 200 can be used effectively in all cutting situations for more control (i.e., the moving thumb blade member 201 faces the palm of the user's hand), since the thumb activated member tends to move relative to the finger blade member 203. For example, when cutting hair, this would allow the user to support the still finger blade member 203 on the fingers holding the hair to be cut to thereby increase stability and reduce the possibility of injury. Thus, the scissors 200 can be used for more controlled cutting with less risk of injury.

FIG. 5 illustrates a bottom perspective of the embodiment of FIGS. 3 and 4. It shows that the bearing assembly hole 44 is oversized in a direction along the longitudinal axis of the moving blade member 201 to permit the ball bearing assembly 32 to incline within the bearing assembly hole 44.

As shown in FIGS. 3–5, the moving blade member 201 includes a pivot portion 202 that holds the pivot joint assemblies described above. One end of the pivot portion 202 is adjacent to the cutting edge of the moving blade member 201, while the other end is adjacent to a handle hinge portion 204. The handle hinge portion 204 is illustrated as having a substantially block "C" shaped notch for receiving and hingeably securing a handle between a pair of hinge support members 206. The notch of the handle hinge portion 204 extends into the pivot portion 202 of the moving blade member 201, so that a part of the engagement surface 56 of the tension screw 50 overhangs the notch as shown in FIGS. 3 and 4. In alternative embodiments, a plurality of notches and hinge support members may be used, or different shape notches and hinge members may be used to secure a handle to the scissors 200. Each of the hinge support members 206 have a hinge pin hole (not shown) provided for securing a hinge pin 208. Alternative embodiments, may use hinge devices other than a hinge pin, such as rivets, nuts and bolts or the like.

The scissors 200 also includes a thumb handle 210 that has a thumb hole portion 212 and a hinge connecting portion 214. The hinge connecting portion 214 is shaped to fit within the handle hinge portion 204 of the moving blade member 201, and includes a hinge pin hole 216 for rotatably receiving the hinge pin 208. The thumb handle 210 is rotatably secured (e.g., hinged) by the hinge connecting portion 214 to the handle hinge portion 204 of the moving member 201 by the hinge pin 208 passing through the hinge pin hole 216, and the ends of the hinge pin 208 are secured in the hinge pin holes of the hinge support members 206.

The hinge connecting portion 214 has a lever force transmitting end 218 for engaging the engagement surface 56 of the tension screw 50, when the thumb handle 210 is secured to the hinge portion of the moving blade member 201. The lever force transmitting end 218 is formed on the hinge connecting portion 214 on the side of the hinge pin 208 opposite the side of the hinge connecting portion 214 that is connected to the thumb hole 212 of the thumb handle portion 210. Thus, as the thumb handle 210 is rotated about the hinge pin 208, by movement of a thumb acting on the thumb hole 212, the hinge pin 208 acts as a fulcrum to apply a lever force on the engagement surface 56 of the tension screw 50.

In preferred embodiments, the tension screw 50 of the scissors 200 is formed from a flexible material, such as nylon, plastic, composites of metal and plastic, or the like, to allow the tension screw 50 to more easily flex while applying the lever force to the ball bearing assembly 32. In alternative embodiments, a flexible threaded post made of flexible material, such as nylon, plastic or the like, is used with a metal threaded finger nut in place of the tension screw 50. The harder metal finger nut would resist deformation under the lever force and the flexible threaded post would provide the desired level of flexibility.

As a lever force is applied to the engagement surface 56 of the tension screw 50, by the lever force transmitting end 218 of the hinge connecting portion 214, the threaded portion 52 of the tension screw acts as another fulcrum to apply a lever force to the flange 40 of the ball bearing assembly 32 with a part of the engagement surface 56 of the tension screw 50 on the opposite side of the threads 52, as shown in FIGS. 3 and 4. This lever force on the flange 40 of the ball bearing assembly 32, alters the inclination of the ball bearing assembly 32 in the bearing assembly hole 44, which changes the load transverse to the pivot axis on the pivot joint to create a moment force and increase or decrease the tension and friction along the cutting edges of the blade members.

The scissors 200 also includes a finger handle 222 that has a finger hole 224. The finger handle 222 is integral with the still blade member 203. In operation, the scissors 200 is grasped by the user, with the thumb placed through the thumb hole 212 of the thumb handle 210, and a finger placed through the finger hole 224 of the finger handle 222.

To use the scissors 200, the user moves the thumb back and forth to produce a scissoring action between the cutting edge of the blade members. However, since the scissors 200 is primarily designed as left-handed scissors for use by a right-handed person, the thumb tends to engage the moving blade member 16 in a manner that tends to pull the cutting edges of the blade members away from each other. This tends to decrease friction, and increase wear and instability in the scissors.

With the inclusion of the hinged thumb handle 210 of the scissors 200, the thumb rotates the thumb handle 210 about the hinge pin 208. As the thumb handle 210 rotates about the hinge pin 208, it applies a lever force to a part of the engagement surface 56 of the tension screw 50, which forces an opposite part of the engagement surface 56 to contact and engage the flange 40 of the ball bearing assembly 32. The engagement of the flange 40 further inclines the ball bearing assembly 32 in the bearing assembly hole 44, which in turn increases the load transverse (or moment force) to the pivot axis on the scissors 200. The increased load transverse on the pivot axis forces the cutting edges of the blade members together and further increases the tension and friction on the cutting edges. Thus, the increased load transverse (or moment force) to the pivot axis substantially offsets or reduces the effect of the pull away motion (or tension and friction reducing effects) of the thumb in the thumb hole 212 of the thumb handle 210. Thus, proper cutting tension and friction are maintained.

In alternative embodiments, the use of a right-handed scissors that is formed like the scissors 200 for use by a left-handed person can be effected in a similar manner and would have the same attributes as the scissors 200 described above. In other embodiments, the hinged handle arrangement, may be adapted for use on scissors having symmetrical handles, rather than the asymmetrical handles shown in FIGS. 3–5.

A third improved scissors 300 in accordance with another alternative embodiment of the present invention is shown in FIGS. 6–10. Structural differences between the scissors 200 and the first embodiment described above are shown in FIGS. 6–10, and the similar structural elements are numbered with like numbers corresponding to the numbers in the second embodiment. The scissors 300, like the scissors 200, has a thumb handle and a finger handle interchanged so that the scissors 300 would be designed for use by a particular handed person (e.g., a left-handed person), if no other modifications are made. However, one of the handles of the scissors 300 in FIGS. 11–15 is then further modified for use by an other-handed person (e.g., a left-handed scissors for use by a right handed person).

As shown in FIGS. 6–10, the still blade member 303 (or finger member) of the scissors 300, contains the ball bearing assembly 32 and the connecting pin 12 in a pivot joint hole in the form of the bearing assembly hole 44. The still blade member 303 also includes the tension screw 50 that is threaded into the tension hole 58 to contact and engage the flange 40 of the ball bearing assembly 32 to adjust the tension and friction between the blade members 301 and 303. The moving blade member 301 (or thumb member) contains the threaded end 26 of the connecting pin 12 in the threaded connecting pin hole 34. Since the finger handle and still blade member 303 holds the bearing assembly, the pivot joint would be orientated to face in a different direction relative to the palm of the user's hand that is opposite that shown in the embodiment of FIGS. 3–5. The scissors 300 illustrated in FIGS. 6–10 would be suitable for use by left-handed persons, if no levered handle was present. Using a left-handed scissors in a right-hand has the benefit of placing the moving thumb blade member 301 away from an area or other fingers during the cutting operation. Embodiments of the scissors 300 can be used effectively in all cutting situations for more control (i.e., the moving thumb blade member 301 faces the palm of the user's hand), since the thumb activated member 301 tends to move relative to the finger blade member 303. For example, when cutting hair, this would allow the user to support the still finger blade member 303 on the fingers holding the hair to be cut to thereby increase stability and reduce the possibility of injury. Thus, the scissors 300 can be used for more controlled cutting with less risk of injury.

Figure 8:
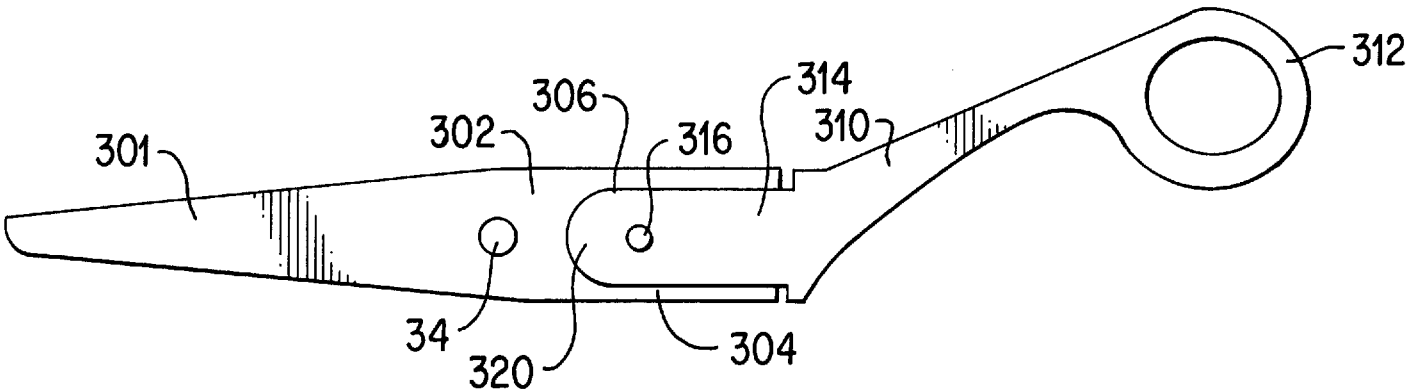
FIG. 8 is a partial bottom perspective view of the scissors handle shown in FIG. 6.

FIG. 8 illustrates a bottom perspective of the moving blade member 303 from the embodiment of FIGS. 6, 7, 9, and 10. It shows that the connecting pin hole 34 is threaded to receive the threaded end 26 of the connecting pin 12.

Figure 9:
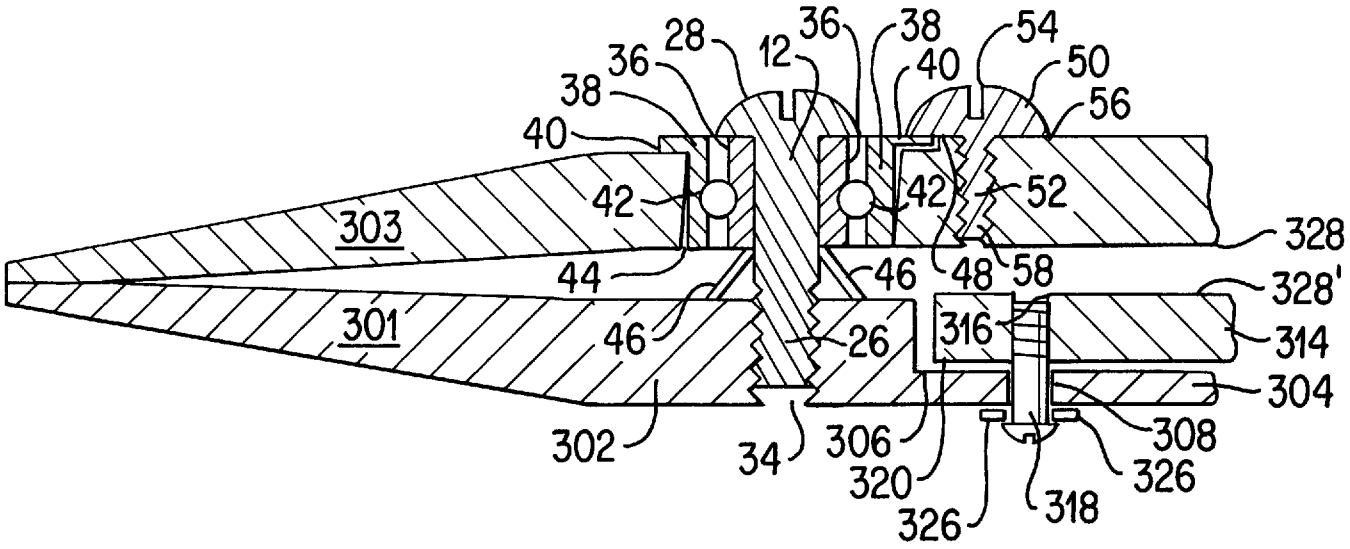
FIG. 9 is a partial cross-sectional view of the scissors shown in FIG. 6 as viewed along the line 9—9.

As shown in FIGS. 8 and 9, the moving blade member 301 includes a pivot portion 302. One end of the pivot portion 302 is adjacent to the cutting edge of the still blade member 303, while the other end is adjacent to a lever joint portion 304. The lever joint portion 304 is illustrated as having a rounded lever notch 306 cut into the underside surface of the lever joint portion 304 for receiving and securing a handle, while permitting lever action between the lever joint portion 304 and the handle. The lever notch 306 of the lever joint portion 304 extends into the pivot portion 302 of the moving blade member 301 near the connecting pin hole 34. In alternative embodiments, the lever notch may be formed in a rectangular or other angular shape or a plurality of lever notches may be formed. The lever joint portion 304 also includes a smooth oversized lever support bore 308. In preferred embodiments, the lever support bore is an oversized circular hole. However, in alternative embodiments, the lever support bore may be oversized in only one direction (i.e., along the longitudinal axis of the moving blade member 14) or the lever support bore may be formed in different shapes.

The scissors 300 also includes a thumb handle 310 that has a thumb hole portion 312 and a lever joint connecting portion 314. The lever joint connecting portion 314 is shaped to fit within the lever notch 306 of the lever joint portion 304 of the moving blade member 301, and includes a threaded lever support hole 316 for receiving the a lever support screw 318 that acts as a support for the lever joint. The thumb handle 310 is loosely secured (e.g., levered) by the lever joint connecting portion 314 being connected to the lever joint portion 304 of the moving blade member 301. The connection is secured by the lever support screw 318 passing through the lever support bore 308 in the moving blade member 301, and by being threaded into the threaded lever support hole 316 in the lever joint connecting portion 314 of the thumb handle 310.

Figure 10:
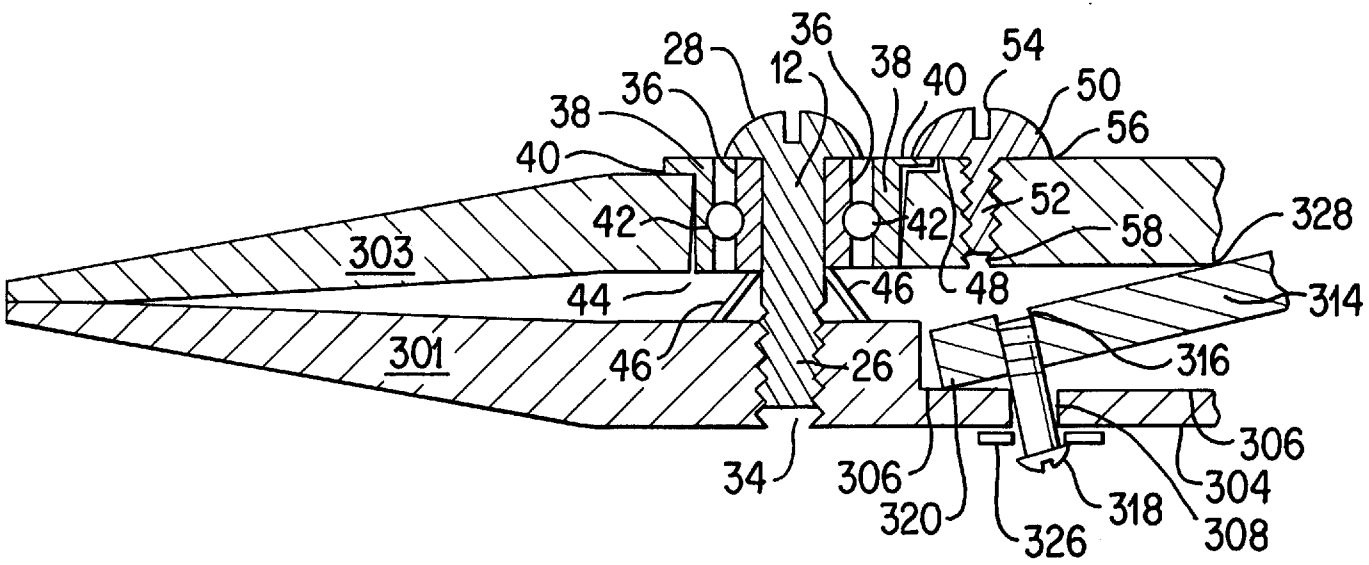
FIG. 10 is another partial cross-sectional view of the scissors shown in FIG. 6 as viewed along the line 9—9.

The lever joint connecting portion 314 has a lever force transmitting end 320 for engaging the end of the lever notch 306, when the thumb handle 310 is secured to the lever joint portion 304 of the moving blade member 301. The lever force transmitting end 320 is formed on the lever joint connecting portion 314 on the side of the lever support screw 318 that is opposite the side on which the lever joint connecting portion 314 is connected to the thumb hole 312 of the thumb handle portion 310. Thus, the thumb handle 310 is levered about the lever support screw 318 in the lever support bore 308 by movement of a thumb acting on the thumb hole 312 such that the range of movement of the thumb handle 310 and lies substantially within a plane paralell to the pivot axis. The lever screw 318 acts as a support for the thumb handle 310 and as the thumb of the user acts on the thumb handle a ride contacting area 328' of the lever joint connecting portion 314 is inclined into contact with the ride area 328 of the still blade member 303 (or finger member). The contact between the ride contacting area 328' of the lever joint connecting portion 314 and the ride area 328 acts as fulcrum to apply a lever force on the end of the lever notch 306, as shown in FIG. 10. As a lever force is applied to the end of the lever notch 306 by the lever force transmitting end 320 of the lever joint connecting portion 314, a flanged head 28 on the end of the connecting pin 12 acts as another fulcrum to apply a lever force to the moving blade member 303 on the opposite side of the connecting pin 12, as shown in FIG. 10. This lever force effectively increases the tension and friction along the cutting edges of the blade members 301 and 303.

The scissors 300 also includes a finger handle 322 that has a finger hole 324. The finger handle 322 is coupled to the still blade member 303 (or finger member). In operation, the scissors 300 is grasped by the user, with the thumb placed through the thumb hole 312 of the thumb handle 310, and a finger placed through the finger hole 324 of the of the finger handle 322.

To use the scissors 300, the user moves the thumb back and forth to produce a scissoring action between the cutting edge of the blade members. However, since the scissors 300 is primarily designed as left-handed scissors for use by a right-handed person, the thumb tends to engage the moving blade member 303 in a manner that tends to pull the cutting edges of the blade members 301 and 303 away from each other. This tends to decrease friction, and increase undesired wear and instability in the scissors.

With the inclusion of the levered thumb handle 310 of the scissors 300, the thumb rotates the thumb handle 310 about the lever support screw 318. As the thumb handle 310 levers about the lever support screw 318, it applies a lever force to the lever notch 306 of the moving blade member 301, which forces the moving blade member 301 on the opposite side of the connecting pin 12 to more firmly contact and engage the cutting edges of the still blade member 303. This effectively increases the tension and friction on the cutting edges. Thus, the increased lever force on the pivot joint substantially offsets or reduces the effect of the pull away motion (or tension and friction reducing effects) of the thumb in the thumb hole 312 of the thumb handle 310. Thus, proper cutting tension and friction are maintained.

In preferred embodiments, the lever support screw 318 of the scissors 300 is formed from a solid metal which is stably maintained in the unlevered position (see FIG. 9) by a belleville washer 326 or the like. In alternative embodiments, the belleville washer may be replaced with a rubber washer, elastomeric o-ring or gasket. The Belleville washer may also be omitted; however, this may make the handle connection less stable when no lever force is applied. However, in other alternative embodiments, the lever screw may be formed of a flexible material, such as nylon, plastic, composites of metal and plastic, or the like, to allow the lever support screw 318 to more easily flex while applying the lever force to lever notch 306, or may even be formed intregal with the lever force transmitting end 320 or lever joint connecting portion 314 to fulfill similar support functions. In still other alternatives, a flexible threaded post made of flexible material, such as nylon, plastic or the like, is used with a metal threaded finger nut in place of the lever screw 318. The harder metal finger nut would resist deformation under the lever force and the flexible threaded post would provide the desired level of flexibility.

In further embodiments, the levered handle arrangement described above, can be applied to traditional scissors that use a pivot axial load to force the blade members together. In this embodiment the levered handle applies a lever force to the pivot joint either directly or through a separate tension adjusting member to increase the pivot axial load to increase tension and friction along the cutting edges of the blade members. The increased pivot axial load forces the cutting blades together and substantially offsets or reduces the effects of the motion of the thumb in the thumb hole of the thumb handle.

Figure 11:
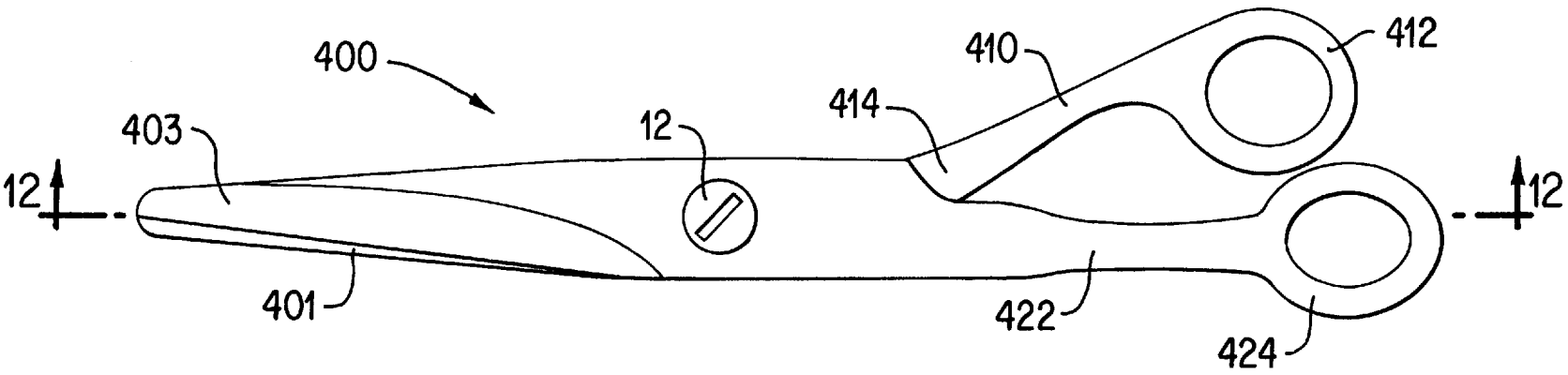
FIG. 11 is a top perspective view of a scissors in accordance with a fourth embodiment of the present invention.
Figure 12:
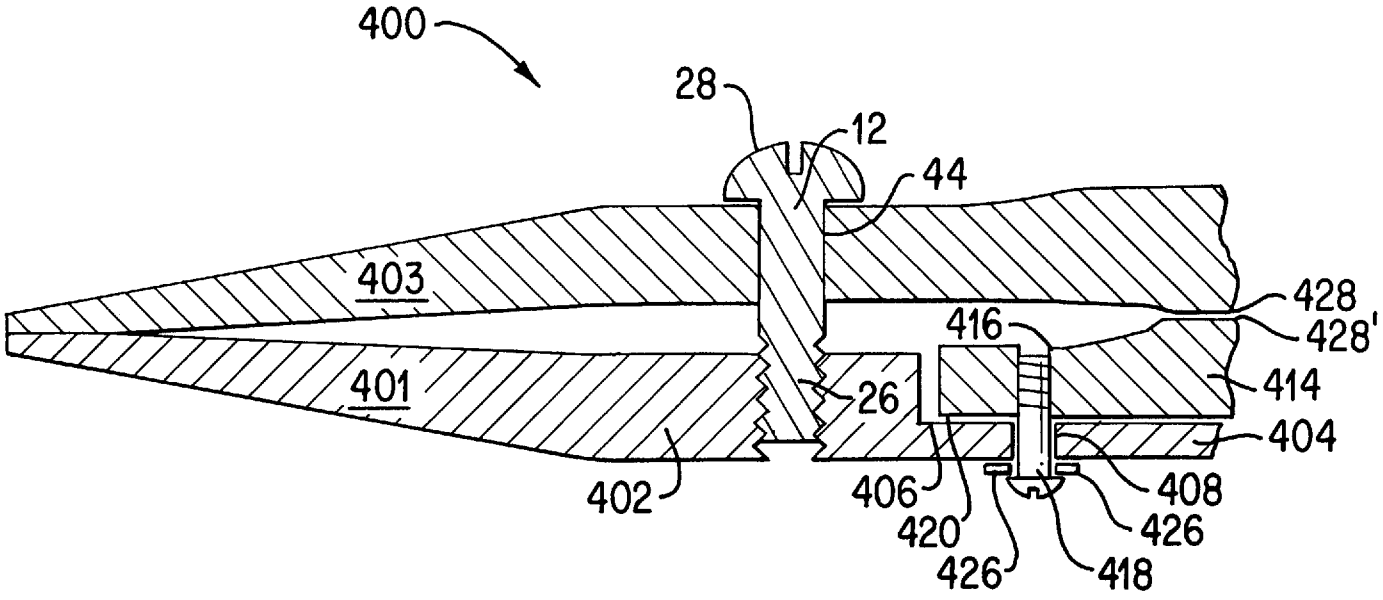
FIG. 12 is a partial cross-sectional view of the scissors shown in FIG. 11 as viewed along the line 12—12.

A fourth improved scissors 400 in accordance with yet another alternative embodiment of the present invention is shown in FIGS. 11 and 12. Structural differences between the other embodiments described above are shown in FIGS. 11 and 12, and the similar structural elements are numbered with like numbers corresponding to the numbers in the second and third embodiments. The scissors 400, like the scissors 200 and 300, has a thumb handle and a finger handle interchanged so that the scissors 400 would be designed for use by a particular handed person (e.g., a left-handed person). However, the scissors 400 in FIGS. 11 and 12 uses a traditional pivot joint and has a handle that is further modified for use by an other-handed person (e.g., a left-handed scissors for use by a right handed person). This embodiment represents the application of the levered or hinged handle to a scissors utilizing a traditional pivot joint.

As shown in FIGS. 11 and 12, the still blade member 403 (or finger member) of the scissors 400 uses a connecting pin 12 without the ball bearing assembly 32. The connecting pin 12 is maintained in the pivot joint hole 44' by a flanged head 28 of the connecting pin 12. The moving blade member 301 (or thumb member) contains the threaded end 26 of the connecting pin 12 in the threaded connecting pin hole 34. Contact between the cutting edge of the blade members is maintained by the lever force exerted in the ride area 428 between the blade members 401 and 403. The scissors 400 illustrated in FIGS. 11 and 12 would be suitable for use by left-handed persons, if no levered handle was present. Using a left-handed scissors in a right-hand has the benefit of placing the moving thumb blade member 401 away from an area or other fingers during the cutting operation. Embodiments of the scissors 400 can be used effectively in all cutting situations for more control (i.e., the moving thumb blade member 401 faces the palm of the user's hand), since the thumb activated blade member tends to move relative to the finger blade member 403. For example, when cutting hair, this would allow the user to support the still finger blade member 403 on the fingers holding the hair to be cut to thereby increase stability and reduce the possibility of injury. Thus, the scissors 400 can be used for more controlled cutting with less risk of injury.

As shown in FIGS. 11 and 12, the moving blade member 401 includes a pivot portion 402. One end of the pivot portion 402 is adjacent to the cutting edge of the moving blade member 401, while the other end is adjacent to a lever joint portion 404. The lever joint portion 404 is illustrated as having a rounded lever notch 406 cut into the underside surface of the lever joint portion 404 for receiving and securing a handle, while permitting lever action between the lever joint portion 404 and the handle such that the range of movement of the handle lies substantially within a plane paralell to the pivot axis. The lever notch 406 of the lever joint portion 404 extends into the pivot portion 402 of the moving blade member 401 near the connecting pin hole 34. The bottom perspective view of the preferred embodiment of the moving blade member 401 is similar to that shown in FIG. 8 of the previous embodiment. In alternative embodiments, the lever notch may be formed in a rectangular or other angular shape or a plurality of lever notches may be formed. The lever joint portion 404 also includes a smooth oversized lever support bore 408. In preferred embodiments, the lever support bore is an oversized circular hole. However, in alternative embodiments, the lever support bore may be oversized in only one direction (i.e., along the longitudinal axis of the moving blade member 401) or the lever support bore may be formed in different shapes.

The scissors 400 also includes a thumb handle 410 that has a thumb hole portion 412 and a lever joint connecting portion 414. The lever joint connecting portion 414 is shaped to fit within the lever notch 406 of the lever joint portion 404 of the moving blade member 401, and includes a threaded lever support hole 416 for receiving the a lever support screw 418 that acts as a support for the lever joint. The thumb handle 410 is loosely secured (e.g., levered) by the lever joint connecting portion 414 being connected to the lever joint portion 404 of the moving blade member 401. The connection being secured by the lever support screw 418 passing through the lever support bore 408 in the moving blade member 401, and by being threaded into the threaded lever support hole 416 in the lever joint connecting portion 414 of the thumb handle 410.

The lever joint connecting portion 414 has a lever force transmitting end 420 for engaging the end of the lever notch 406, when the thumb handle 410 is secured to the lever joint portion 404 of the moving blade member 401. The lever force transmitting end 420 is formed on the lever joint connecting portion 414 on the side of the lever support screw 418 opposite the side of the lever joint connecting portion 414 that is connected to the thumb hole 412 of the thumb handle portion 410. Thus, the thumb handle 410 is levered about the lever support screw 418 in the lever support bore 408, by movement of a thumb acting on the thumb hole 412, the lever screw 418 acts as a support for the thumb handle 410 as a ride contacting area 428' of the lever joint connecting portion 414 is inclined into contact with ride area 428 of the still blade member 403 (or finger member). The contact between the ride area 428' of the lever joint connecting portion 414 and the ride area 428 acts as a fulcrum to apply a lever force on the end of the lever notch 406. As a lever force is applied to the end of the lever notch 406 by the lever force transmitting end 420 of the lever joint connecting portion 414, the flanged head 28 of the connecting pin 12 acts as another fulcrum to apply a lever force to the moving blade member 401 on the opposite side of the connecting pin 12. This lever force effectively increases the lever force being applied in the ride area 428 to increase the tension and friction along the cutting edges of the blade members 401 and 403.

The scissors 400 also includes a finger handle 422 that has a finger hole 424. The finger handle 422 is coupled to the still blade member 403. In operation, the scissors 400 is grasped by the user, with the thumb placed through the thumb hole 412 of the thumb handle 410, and a finger placed through the finger hole 424 of the of the finger handle 422.

To use the scissors 400, the user moves the thumb back and forth to produce a scissoring action between the cutting edge of the blade members. However, since the scissors 400 is primarily designed as left-handed scissors for use by a right-handed person, the thumb tends to engage the moving blade member 401 in a manner that tends to pull the cutting edges of the blade members 401 and 403 away from each other. This tends to decrease friction, and increase undesired wear and instability in the scissors.

With the inclusion of the levered thumb handle 410 of the scissors 400, the thumb rotates the thumb handle 410 about the lever screw 418. As the thumb handle 410 rotates about the lever support screw 418, it applies a lever force to the lever notch 406 of the moving blade member 401, which forces the moving blade member 401 on the opposite side of the connecting pin 12 to more firmly contact and engage the cutting edges of the still blade member 403. This effectively further increases the lever force on the other side of the connecting pin 12 in the contacting ride areas 428 and 428' between the moving blade member 401 and the still blade member 403, which in turn increases the pivot axial load on the connecting pin 12 and increases the tension and friction on the cutting edges. Thus, the increased lever force on the pivot joint substantially offsets or reduces the effect of the pull away motion (or tension and friction reducing effects) of the thumb in the thumb hole 412 of the thumb handle 410. Thus, proper cutting tension and friction are maintained.

In preferred embodiments, the lever support screw 418 of the scissors 400 is formed from a solid metal which is stably maintained in the unlevered position (see FIG. 12) by a rubber gasket 426 or the like. In alternative embodiments, the rubber gasket may be replaced with a rubber washer, elastomeric o-ring, belleville washer or the like. In further alternative embodiments, the lever support screw functions may be accomplished by use of a flexible material, such as plastic, spring steel or the like, in the lever force transmitting end 420 together with a solid attachment of the lever force transmitting end 420 to the lever notch.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A scissors, comprising:

a first blade member with a first cutting section;

a second blade member with a second cutting section;

a pivot joint member having a pivot axis coupled and secured to the first and second blade members to form a pivot joint that permits relative pivotal movement of the first and second blade members about the pivot axis of the pivot joint member that places the first and second cutting sections in contact;

a first handle having a portion engaged with the first blade member and an end portion that contacts the pivot joint member, wherein the first handle is connected to the first blade member and the portion of the first handle presses against the first blade member and the end portion of the first handle lifts the pivot joint member during movement of the first handle relative to the first blade member;

wherein the movement of the first handle relative to the first blade member causes the first handle in contact with the pivot joint member to pull the pivot joint member away from the first blade member and correspondingly pull the second blade member towards the first blade member to increase compression between the first and second blade members and increase tension between the first and second cutting sections.

2. The scissors in accordance with claim 1, wherein the first handle is engaged by a thumb to orient the first blade member to face a palm of a user's hand, and wherein the second handle is engaged by fingers to orient the second blade member to face away from the palm of the user's hand during movement of the first and second blade members.

3. The scissors in accordance with claim 2, wherein the first handle is secured by a connection to a portion of the pivot joint member and wherein a flexible means for permitting movement is disposed between the pivot joint member and the the first handle.

4. The scissors according to claim 3, wherein the pivot joint member includes a pivot joint pin, wherein the first handle is secured by a connection to a portion of the pivot joint member which includes a flanged head at one end of the pivot joint pin and wherein a flexible means for permitting movement is disposed between the flanged head of the pivot joint pin and the first handle.

5. The scissors in accordance with claim 1, wherein the first handle is secured by a connection to a portion of the pivot joint member and wherein a flexible means for permitting movement is disposed between the pivot joint member and the first handle.

6. The scissors according to claim 5, wherein the pivot joint member includes a pivot joint pin, wherein the first handle is secured by a connection to a portion of the pivot joint member which includes a flanged head at one end of the pivot joint pin and wherein a flexible means for permitting movement is disposed between the flanged head of the pivot joint pin and the first handle.

7. The scissors in accordance with claim 1, wherein the first blade member includes a notch adapted to receive a portion of the first handle and the portion to engage with the first handle.

8. The scissors in accordance with claim 7, wherein the portion of the first handle includes a first ride contacting area on an opposite side of the portion of the first handle, wherein the second blade member includes a second ride contacting area between the second cutting section and the second handle, wherein the first ride contacting area is pressed into contact with the second ride contacting area so that the contact between the first ride contacting area and the second ride area acts as a fulcrum when the first handle engages the first blade member.

9. The scissors according to claim 7, wherein the notch extends through a thickness of the first blade member, wherein the first blade member further includes an adjustment member that overhangs an end of the extended through notch, and wherein the adjustment member engages with the portion of the first blade member.

* * * * *